United States Patent [19]

Dobbins

[11] 3,960,315

[45] June 1, 1976

[54] CARTON WITH INSPECTION FLAP AND BLANK THEREFOR

[75] Inventor: Thomas Edward Dobbins, Neenah, Wis.

[73] Assignee: American Can Company, Greenwich, Conn.

[22] Filed: Mar. 27, 1975

[21] Appl. No.: 562,913

[52] U.S. Cl. ..... 229/87 F; 426/121; 426/122

[51] Int. Cl.[2] ..... B65D 65/12; B65D 65/14; B65D 65/18; B65D 65/32

[58] Field of Search ..... 229/87 F; 426/121, 122, 426/123, 129; 206/45.31

[56] References Cited

UNITED STATES PATENTS

| | | | |
|---|---|---|---|
| 2,940,655 | 6/1960 | Dunning | 229/87 F |
| 3,360,119 | 12/1967 | Mullinix | 426/121 |
| 3,409,445 | 11/1968 | Hall | 229/87 F X |

*Primary Examiner*—Stephen P. Garbe
*Attorney, Agent, or Firm*—Robert P. Auber; Ira S. Dorman; John M. Winter

[57] ABSTRACT

A paperboard carton and blank therefor for displaying a product such as bacon having a top panel with a cut-out viewing area and hinged inspection flap adjacent a reinforced edge portion formed by a glue flap overlapping the edge section of the top panel.

11 Claims, 7 Drawing Figures

CARTON WITH INSPECTION FLAP AND BLANK THEREFOR

BACKGROUND OF THE INVENTION

1. FIELD OF THE INVENTION

This invention relates to a paperboard carton and blank therefor and more particularly to a carbon suitable for storing and displacing bacon or the like having a top panel with a hinged inspection flap.

2. DESCRIPTION OF THE PRIOR ART

Government regulations require that the consumer be able to see 70 percent of the surface of a representative slice of bacon in a package. The specific regulations are set forth in 9 C.F.R. Sec. 317.8. Cartons complying with the government regulations suitable for storing and displaying bacon slices having top panels with inspection flaps are well-known in the industry. A serious problem with the prior art cartons is that the inspection flap, when lifted by consumers, is often torn beyond the hinge line upon which it is folded. This tearing of the inspection flap beyond the hinge line results in breaking the seal of the package and presenting subsequent consumers with an unattractive and broken package which is no longer salable at normal competitive prices.

SUMMARY OF THE INVENTION

The present invention provides a carton and blank therefor constructed to allow a view of a representative slice of bacon. The invention provides a hinged inspection flap adjacent a reinforced edge portion. The reinforced edge portion prevents tearing of the inspection flap beyond the hinge line connecting it to the top panel of the carton. A glue flap overlaps an edge section of equal width of the top panel, providing a reinforced edge portion having two thicknesses of paperboard secured together. In a first embodiment, the edge portion is further reinforced by gluing the transparent material covering the cut-out viewing area to the inner surface of the edge section of the top panel.

In a second embodiment the edge section of the top panel is provided with an extended glue-back flap which is folded back and glued to the edge section of the top panel to further strengthen the reinforced edge portion adjacent the hinge line of the inspection flap. An opening tab hingedly connected to the glue flap along a fold line and partially overlapping the inspection flap further prevents tearing beyond the hinge line, facilitates opening the carton, and provides a restoring force to keep the inspection flap in a closed position.

Further objects, features and advantages of my invention will become apparent from the following detailed description taken in conjunction with the accompanying drawings showing preferred embodiments for exemplification.

DETAILED DESCRIPTION OF THE PREFERRED EMBODIMENTS

Figure 1:
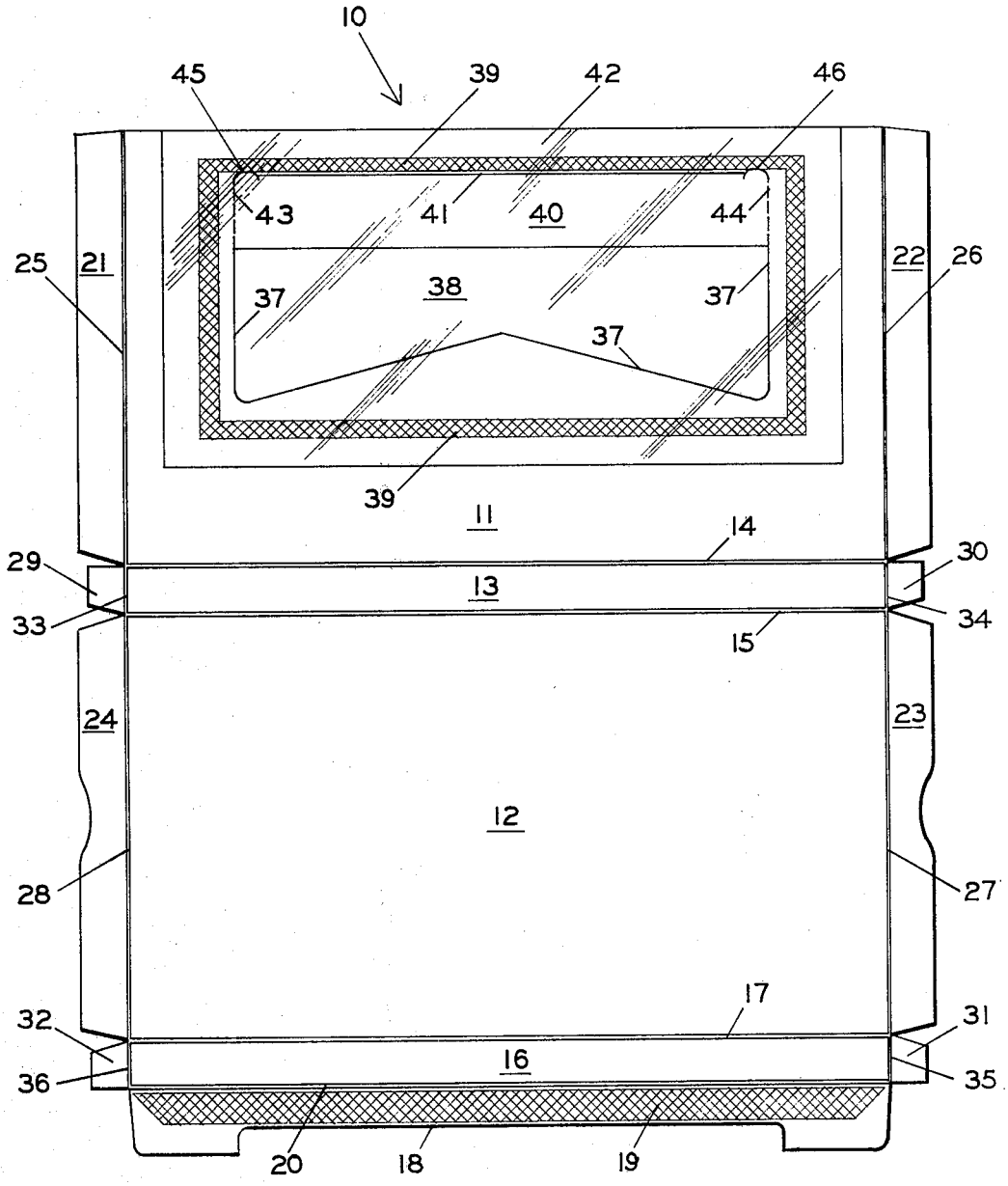
FIG. 1 is a plan view of a carton blank comprising a preferred embodiment of my invention.
Figure 2:
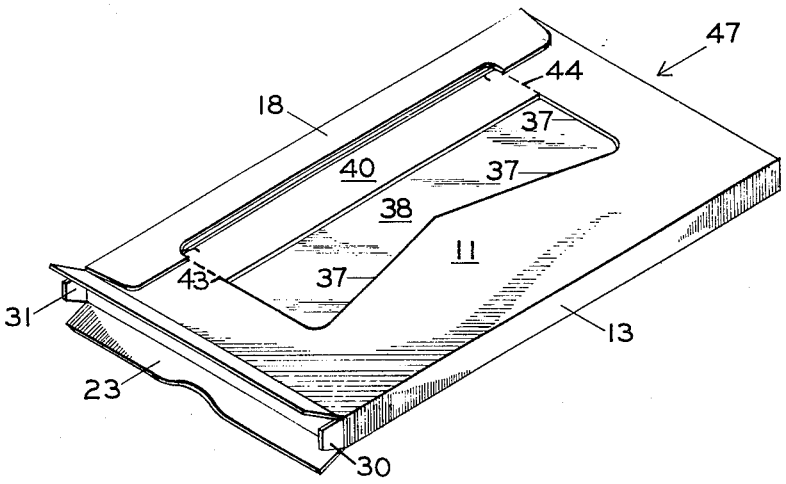
FIG. 2 is a perspective view of a carton formed from the blank of FIG. 1 ready to receive a product such as bacon, shown with the inspection flap in its closed position.
Figure 3:
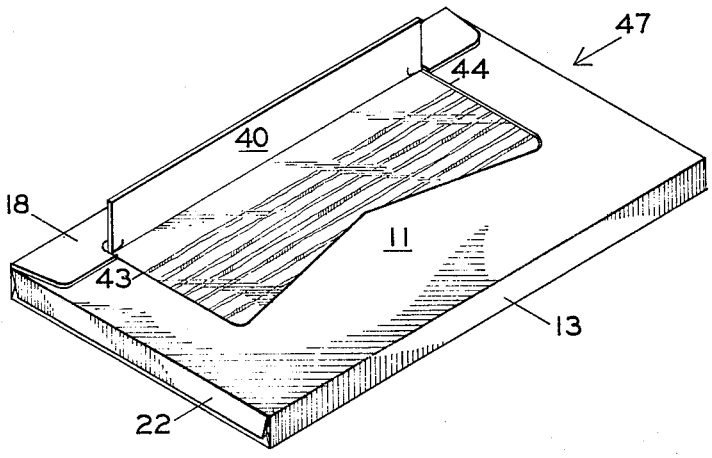
FIG. 3 is a perspective view of a carton formed from the blank of FIG. 1 sealed with the product such as bacon therein, shown with the inspection flap in an open position.

The inside surface of a blank 10 as illustrated in FIG. 1 corresponding to the interior of the carton shown in FIGS. 2 and 3 is composed of a top panel 11 and a bottom panel 12 connected together by a first side wall 13 along fold lines 14 and 15 respectively. A second side wall 16 is hingedly connected to the bottom panel 12 along a fold line 17. A glue flap 18 having adhesive 19 spread along its surface is hingedly connected to the second side wall 16 along a fold line 20. End flaps 21–24 are hingedly connected to the top and bottom panels along fold lines 25–28 respectively. End tabs 29–32 are hingedly connected to the first and second side walls along fold lines 33–36 respectively.

The top panel 11 has a cut-out viewing area 37 covered by a transparent material such as a plastic film 38 secured by adhesive 39 to the top panel along the perimeter of the viewing area 37. An inspection flap 40, coincident with at least a portion of the cut-out viewing area 37, is hingedly connected to the top panel 11 along a hinge line 41 adjacent an edge section 42 of the top panel corresponding in width to the glue flap 18. The sides of the inspection flap 40 are connected to the top panel 11 by lines of weakness 43 and 44 which end in semi-circular cuts 45 and 46 adjacent the edge section 42 of the top panel. It is to be noted that the plastic film 38 is secured by adhesive 39 to the edge section 42 of the top panel adjacent the hinge line 41 of the inspection flap 40.

FIGS. 2 and 3 illustrate a carton 47 constructed from the blank 10 of FIG. 1. FIG. 2 shows the carton 47 with a set of end flaps and tabs open to receive a product such as shingled bacon. The inspection flap 40 is shown in a closed position with its sides still connected to the top panel 11 along lines of weakness 43 and 44.

FIG. 3 illustrates the sealed carton 47 with shingled bacon slices located therein. Bacon is generally packed in a shingled fashion to protect the fatty portions of the slices from exposure to ultra-violet light which causes the fat to discolor and deteriorate. inspection flap 40 allows the consumer to view a representative top slice of bacon which is not covered by the lean portions of other slices. When the inspection flap 40 is in its normal closed position, the fatty portion of the representative top slice is protected from exposure to ultra-violet light. While the leaner portions of the bacon slices visible in the cut-out viewing area 37 are not seriously affected by exposure to ultra-violet light, it is to be understood that the dimensions of the inspection flap 40 shown covering a portion of the cut-out viewing area 37 could be increased to cover the entire viewing area to prevent any bacon from being exposed, if desired. When a consumer wishes to inspect the representative top slice of bacon the following sequence occurs.

The inspection flap 40 is pulled upward, separating the sides from the top panel along lines of weakness 43 and 44; and then continued pivoting of the inspection flap along hinge line 41 allows a view of the representative top slice of bacon.

It should be noted in FIGS. 2 and 3 that the glue flap 18 overlaps and is glued to the substantially equal width edge section 42 of the top panel illustrated in FIG. 1. The width of the glue flap 18 is its dimension perpendicular to the fold line 20. The double thickness of the glue flap 18 and edge section 42 secured together by adhesive 19 plus the strength of the plastic film 38 secured by adhesive 39 to the inner surface of the edge section 42 provides a reinforced edge portion adjacent the hinge line 41 upon which the inspection flap 40 is pivoted. The possibility that a consumer will tear the carton beyond the hinge line 41 when pulling the inspection flap 40 upward is greatly reduced because of the strength and resistance to tearing of the reinforced edge portion. The semi-circular cuts 45 and 46 further retard a tearing action past the hinge line 41 since the 180° change of direction of the semi-circular cuts tends to direct a tearing force away from rather than toward the reinforced edge portion.

FIGS. 4–7 illustrate a second embodiment of my invention suitable for use with shingled bacon slices vacuum packed in plastic pouches. The labeling of elements is substantially the same as that used in FIGS. 1–3. Modified elements are denoted by the subscript *a* and new elements identified by new numbers. Since a basic understanding of my invention has been provided by the description of the first embodiment shown in FIGS. 1–3, the following description will primarily describe the modified and new elements shown.

Figure 4:
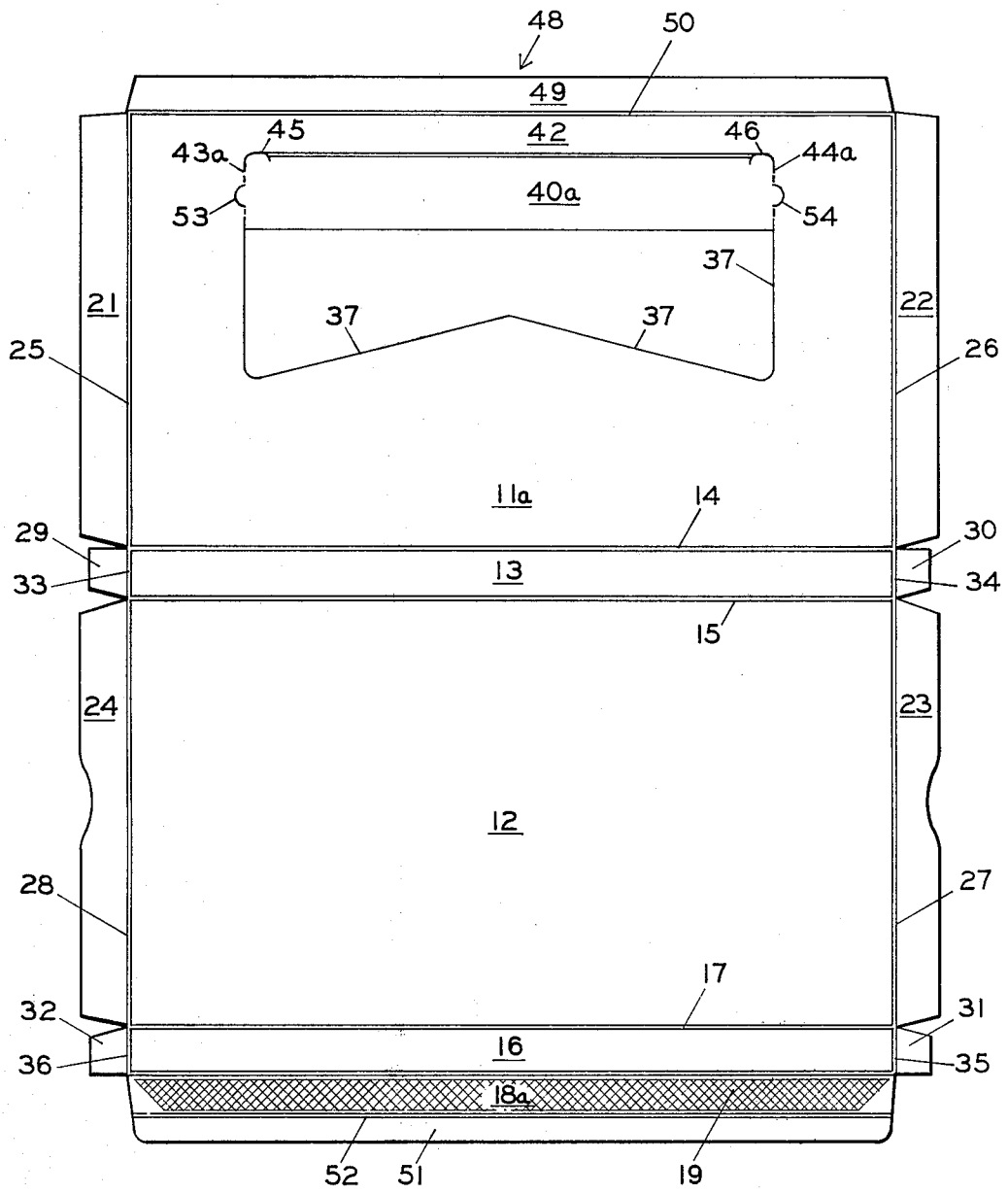
FIG. 4 is a plan view of a carton blank comprising a second preferred embodiment of my invention.

The blank 48 as shown in FIG. 4 does not have a transparent material covering the cut-out viewing area 31 since vacuum packed bacon comes in its own sealed plastic pouch. A glue-back flap 49 is hingedly connected along a fold line 50 to the edge section 42 of the top panel. An opening tab 51 is hingedly connected along a fold line 52 to the glue flap 18*a*. Reclosure tabs 53 and 54 are integrally connected to the sides of the inspection flap 40*a*. The reclosure tabs interrupt the lines of weakness 43*a* and 44*a* and are formed by cuts in the adjacent sections of the top panel 11*a*.

Figure 5:
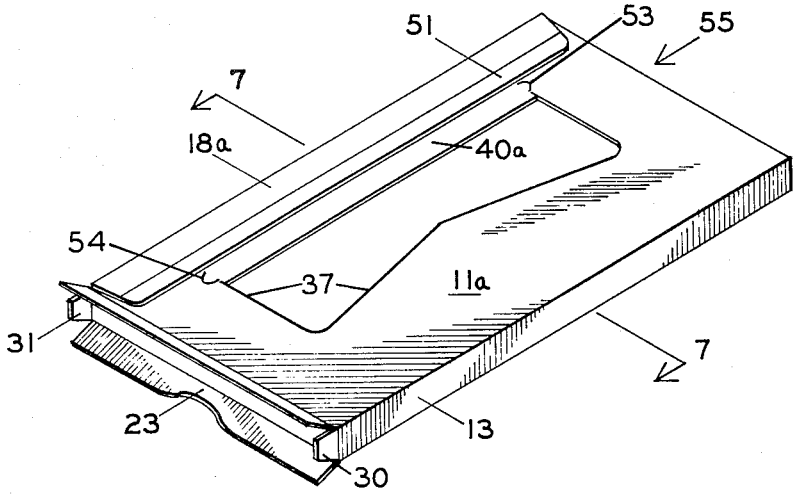
FIG. 5 is a perspective view of a carton formed from the blank of FIG. 4 ready to receive a product such as vacuum packed bacon, shown with the inspection flap in a closed position.
Figure 7:
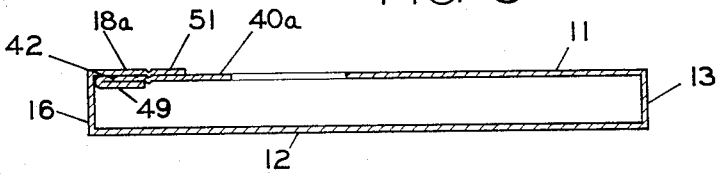
FIG. 7 is a section view taken along section line 7—7 of FIG. 5.
Figure 6:
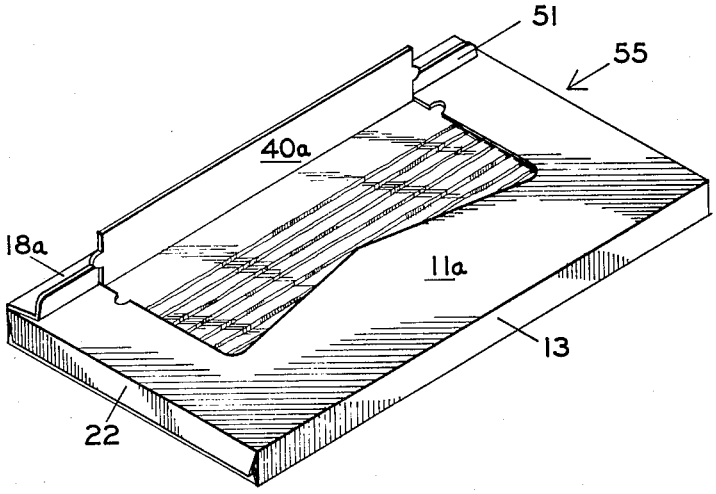
FIG. 6 is a perspective view of a carton formed from the blank of FIG. 4 sealed with the product such as vacuum packed bacon therein, shown with the inspection flap in an open position.

FIGS. 5–7 illustrate a carton 55 constructed from the blank 48 as shown in FIG. 4. The glue back-flap 49 of the carton 48 is folded along the fold line 44 and glued to the inner surface of the edge section 42 of the top panel. The opening tab 51 provides a fingerhold for pulling the glue flap 18*a* and separating it from the edge section 42 of the top panel when it is desired to open the carton to remove the product. The opening tab 51 overlaps the inspection flap 40, reinforcing the inspection flap 40 against tearing beyond the hinge line 41 and also tending, by natural resistance of the paperboard carton material, to force the inspection flap 40 to return to its closed position after being raised for inspection purposes.

As shown in FIG. 7, the glue-back flap 49 and the overlapping glue flap 18*a* are glued to the inner and outer surfaces of the edge section 42 of the top panel resepctively, providing a reinforced edge portion which greatly reduces the possibility of a consumer tearing the inspection flap 40 beyond the hinge line 41 when the inspection flap is raised to inspect the representative slice of bacon. The added tear resistance of the glue-back flap 49 is especially useful in vacuum packed bacon cartons where the strength of a plastic film glued to the inner surface of the edge section 42 of the top panel is not available to retard tearing of the carton.

The reclosure tabs 53 and 54, after initial opening of the inspection flap 40, do not coincide perfectly with the cuts in the adjacent sections of the top panel providing a temporary latching effect which keeps the inspection flap 40 in place when returned to its closed position. Since the fatty portions of the representative slice of bacon tends to deteriorate and discolor upon exposure to ultra-violet light, the tendency of the opening tab 51 to force the inspection flap down to its closed position and the temporary latching effect of the reclosure tabs 53 and 54 are particularly valuable.

It should be understood that the opening tab 51, the reclosure tabs 53 and 54, and the glue-back flap 49 can be used with the carton and blank as shown in FIGS. 1–3, as well as the carton and blank used for vacuum packed bacon shown in FIGS. 4–7.

It is to be further understood that this invention is not limited to the particular construction herein illustrated and described, but embodies all such modified forms as come within the scope of the following claims.

I claim:

1. A carton blank for constructing a carton for displaying a product such as bacon, said blank comprising:

a. a top panel having a cut-out viewing area, b. a bottom panel, c. a glue flap, d. an edge section of the top panel being located between the cut-out viewing area and one edge of the top panel adjacent the cut-out viewing area and having substantially the same width as the glue flap, e. a first side wall hingedly connected along fold lines at opposite edges to the top and bottom panels, said first side wall being connected to said top panel at the edge opposite said edge section of said top panel, f. a second side wall hingedly connected along fold lines at opposite edges to the bottom panel at the edge of the bottom panel opposite the edge thereof to which said first side wall is connected and to the glue flap, g. an inspection flap covering at least a portion of the cut-out viewing area and hingedly connected to the edge section of the top panel along a hinge line and having sides connected to the top panel by lines of weakness, and h. end flaps hingedly connected along fold lines to the side edges of the top and bottom panels.

2. A carton blank as specified in claim 1 further comprising a transparent material covering the cut-out viewing area secured to the top panel adjacent the perimeter of said cut-out viewing area.

3. A carton blank as specified in claim 1 further comprising an opening tab hingedly connected along a fold line to the glue flap.

4. A carton blank as specified in claim 1 further comprising a glue-back flap hingedly connected along a fold line to the edge section of the top panel.

5. A carton blank as specified in claim 1 wherein the lines of weakness connecting the sides of the inspection flap to the top panel terminate in semi-circular cuts adjacent the edge section of the top panel, and wherein the sides of the inspection flap have reclosure tabs cut from the adjacent the sections of the top panel.

6. A carton for displaying a product such as bacon, said carton comprising:

a. a top panel having a cut-out viewing area,
b. a bottom panel,
c. a glue flap,
d. an edge section of the top panel adjacent the cut-out viewing area and having substantially the same width as the glue flap,
e. a first side wall hingedly connected at opposite edges to the top and bottom panels,
f. an inspection flap covering at least a portion of the cut-out viewing area and being hingedly connected to the edge section of the top panel along a hinge line and having sides connected to the top panel by lines of weakness,
g. a second side wall hingedly connected at opposite edges to the bottom panel and to the glue flap, said glue flap overlapping and being secured to the edge section of the top panel and extending to said hinge line of said inspection flap to provide a reinforced edge portion along said hinge line, and
h. end flaps overlapping and secured together, hingedly connected to the side edges of the top and bottom panels.

7. A carton as specified in claim 6 further comprising a transparent material covering the cut-out viewing area secured to the top panel adjacent the perimeter of said cut-out viewing area.

8. A carton as specified in claim 6 further comprising: an opening tab hingedly connected along a fold line to the glue flap, said opening tab partially overlapping the inspection flap.

9. A carton as specified in claim 6 further comprising: a glue-back flap hingedly connected along a fold line to the edge section of the top panel, said glue-back flap being folded back and secured to the edge section to provide a further reinforced edge portion.

10. A carton as specified in claim 6 wherein the lines of weakness connecting the sides of the inspection flap to the top panel terminate in semi-circular cuts adjacent the edge sections of the top panel, and wherein the sides of the inspection flap have reclosure tabs cut from the adjacent sections of the top panel.

11. A carton for displaying a product such as bacon, said carton comprising:
a. a top panel having a cut-out viewing area,
b. a bottom panel hingedly connected to the top panel,
c. a glue flap hingedly connected to the bottom panel,
d. an edge section of the top panel adjacent the cut-out viewing area,
e. an inspection flap covering at least a portion of the cut-out viewing area and being hingedly connected to the edge section of the top panel along a hinge line, and
f. said glue flap overlapping and secured to the edge section of the top panel and having an edge of said glue flap in juxtaposition with said hinge line to inhibit inadvertent tearing of the edge section of the top panel when said inspection flap is opened.

* * * * *

Disclaimer 3,960,315.—*Thomas Edward Dobbins*, Neenah, Wis. CARTON WITH INSPECTION FLAP AND BLANK THEREFOR. Patent dated June 1, 1976. Disclaimer filed May 19, 1980, by the assignee, *American Can Company*

Hereby enters this disclaimer to claims 1, 2, 5, 6, 7, 10 and 11 of said patent.

[*Official Gazette July 1, 1980.*]